US005428930A

United States Patent [19]

Bagley et al.

[11] Patent Number: 5,428,930

[45] Date of Patent: Jul. 4, 1995

[54] CONCEALED GRID CEILING PANEL SYSTEM

[75] Inventors: Claude E. Bagley, Oakville; Dwight D. Robbins, Woodbridge; Wm. Steve Wilson, Milton; Charles B. Stormer; Gary H. Peddle, both of Brampton; Heikki Kolga, Islington; Ronald G. White, Holland Landing; John Balog, Oakville; Conrad Marini, Woodbridge, all of Canada

[73] Assignee: Decoustics Limited, Etobicoke, Canada

[21] Appl. No.: 95,338

[22] Filed: Jul. 23, 1993

[51] Int. Cl.[6] ..... E04B 9/26

[52] U.S. Cl. ..... 52/506.07; 52/483.1; 52/489.1; 52/98; 52/668

[58] Field of Search ..... 52/506.06, 506.07, 506.09, 52/483.1, 489.1, 98, 665, 668, 773, 741.1, 747

[56] References Cited

U.S. PATENT DOCUMENTS

| | | | |
|---|---|---|---|
| 3,102,306 | 9/1963 | Hutchinson | 52/98 X |
| 3,930,338 | 1/1976 | Rood | 49/465 |
| 4,408,428 | 10/1983 | Brooke et al. | 52/506.07 |
| 4,438,613 | 3/1984 | Hintsa et al. | 52/506.09 |
| 4,545,166 | 10/1985 | Kielmeyer | 52/506.06 |
| 4,580,387 | 4/1986 | Rogers | 52/665 |

FOREIGN PATENT DOCUMENTS

| | | | |
|---|---|---|---|
| 0056074 | 5/1911 | Switzerland | 52/506.06 |

*Primary Examiner*—Carl D. Friedman
*Assistant Examiner*—Robert J. Canfield

[57] ABSTRACT

A concealed suspension ceiling system advantageously uses a 'T' bar grid network used for lay-in ceiling panels. Butterfly clips are secured to upper beads of the 'T' bar grid network allowing torsioning springs to releasably maintain the panels suspended beneath the grid. The system can be used for entirely new installations or used in a retrofit application.

17 Claims, 2 Drawing Sheets

CONCEALED GRID CEILING PANEL SYSTEM

FIELD OF THE INVENTION

The present invention relates to ceiling panel systems.

BACKGROUND OF THE INVENTION

One of the most common ceiling panel systems is a 'T' bar ceiling panel system where panels are supported by an exposed 'T' bar grid network. There are many manufacturers of 'T' bar systems and the individual ceiling panels are received above lower flanges of the 'T' bar members which form a frame about the panel. In this type of system, the 'T' bar network, and particularly the lower flanges of the T members are visible. A number of systems are available for defining what is referred to as a concealed grid system. In concealed grid systems, the panels typically abut and hide the support grid network. Most of these systems use torsion springs to initially support the panels at a first position spaced significantly below the grid system with the panels being movable to a second position with the panels in engagement with the grid network. The torsion springs maintain the panels in tight engagement with the lower surface of the grid network. Examples of ceiling panel systems are shown in U.S. Pat. No. 4,438,613 and U.S. Pat. No. 4,548,010.

Due to the extreme popularity of 'T' bar ceiling systems, installers are intimately familiar with these systems and can quickly install a grid network. Furthermore, there are a huge number of buildings which have such grid networks already in place.

SUMMARY OF THE INVENTION

A ceiling system, according to an aspect of the present invention, comprises ceiling panels designed to abut adjacent ceiling panels and collectively define a concealed grid ceiling panel system. A 'T' bar grid system, of a type used in 'T' bar ceiling panel systems used to support ceiling panels above a lower edge of the grid system, is used for defining the grid system for the panels of the concealed grid ceiling system. Clip members are secured at top edges of the 'T' bar grid system and extend to at least one side of the respective 'T' bar member and engage a torsion spring to the side of the respective 'T' bar member. The torsion spring and a lower edge thereof engages a ceiling panel edge and positively supports the ceiling panel beneath the grid. Each ceiling panel includes at least two torsion springs which cooperate to support the ceiling panel immediately beneath the grid, with the top edge of the ceiling panel engaging the lower flanges of the grid system.

It is also possible to use the arrangement, but not fully conceal the grid network. In this case, panels still contact the bottom flange of the grid network and all panels do not necessarily abut, thereby exposing a portion of the grid network.

According to a preferred aspect of the invention, alignment means are secured at a desired position, preferably centrally on the lower edge of the grid members, and this alignment means cooperates with the edges of the panel to align the ceiling panels with the grid network.

According to a further preferred aspect of the invention, the clip members are combined, such that each clip members receives a torsion spring of abutting opposed panels positioned either side of the 'T' bar member of the grid network. According to yet a further aspect of the invention, the clip members are immediately adjacent junctions of the grid network and opposed clip members are combined.

A securing clip, according to the present invention, for use in a suspended ceiling system comprises a first segment and a second segment interconnected by a rigid frangible bridge segment. Each of the first and second segments comprise a top downwardly opening channel for straddling an upper bead of the 'T' bar grid members, with extension flanges either side of the channel. Each flange has a slot therein designed to engage and retain a torsion spring.

According to a further aspect of the invention, the securing clips include a mechanical means for positively securing the clip to the 'T' bar grid member.

According to yet a further aspect of the invention of the securing clip, the frangible bridge segment is the bottom of the downwardly opening channel which overlies the upper bead of a 'T' bar grid member. This bridge segment spaces the first and second segments sufficiently to accommodate a cross member forming a junction with a main T of the 'T' bar grid system.

The invention is also directed to a combination comprising the 'T' bar grid system, securing clips and ceiling panels. The 'T' bar grid system comprises main T's and cross T's forming the grid system. Each securing clip is secured to the grid system at a junction of the grid system and positions a first segment of the clip on a main T to one side of a cross T and positions the second segment of the securing clip on the main T to the opposite side of the cross T. The ceiling panels include torsion springs for suspending thereof from said securing clips. The torsion springs are received in slots of the securing clips and the ceiling panels are sized to generally align corners of the ceiling panels beneath a junction of a main T and cross T with a securing clip positioned to receive and engage a torsion spring of the ceiling panel. The ceiling panels preferably abut and collectively cover the grid network from below.

According to a preferred aspect of the combination, securing clips are grouped in pairs, with the clips of the pair being located on a main T and to either side of a cross T, with the clips of a pair being interconnected by a frangible bridge segment.

A method according to the present invention replaces a 'T' bar grid and panel ceiling system with a concealed grid ceiling system. The method comprises removing the panels of the 'T' bar ceiling system to fully expose the 'T' bar grid, securing clips at an upper edge of the 'T' bar grid system, and positioning of the clips for edge support of the ceiling panels. The clips have slots either side of the 'T' bar grid for engaging torsion springs, and torsion springs are brought into engagement with the clips. Prior to this engagement, the torsion springs are hingedly secured to the ceiling panels in a manner to accommodate horizontal suspension of the ceiling panels beneath the 'T' bar grid. The above generally defines a downwardly accessed ceiling panel system. The method includes initially suspending the ceiling panels in a generally horizontal position beneath the 'T' bar grid by securing of the torsion springs in the clips, with the spacing of the clips on the 'T' bar grid corresponding to the spacing of the springs when secured on a ceiling panel. The panels are then forced upwardly to contact the lower surface of the 'T' bar grid system, with the torsion springs also moving upwardly through the slots of the clips and maintaining the ceiling panels immediately below the 'T' bar grid. The panels, when secured beneath the 'T' bar grid, abut and conceal the 'T' bar grid.

According to a preferred aspect of the invention, the ceiling panels are sized to correspond to a multiple of the cell size of the 'T' bar grid.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
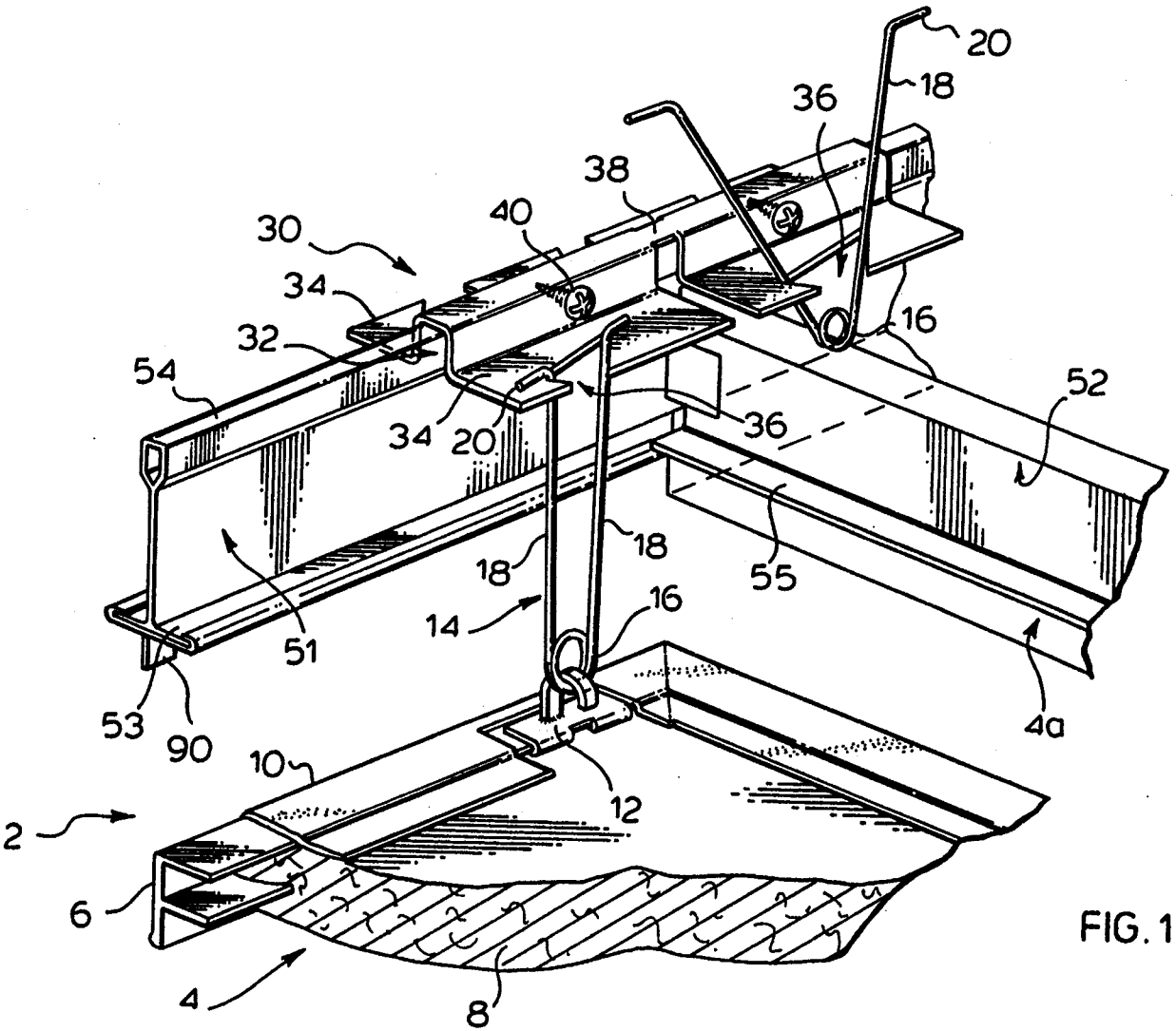
FIG. 1 is a partial perspective view of a concealed grid ceiling system according to the present invention.

The suspended, downwardly accessible, concealed grid ceiling system 2, shown in FIG. 1, is defined by combining the ceiling panels 4, the 'T' bar grid network 50, butterfly clips 30, and torsion springs 14. The ceiling panels 4 have a framed periphery 6 surrounding a body member 8 typically of an acoustical dampening material or other material. Preferably, the ceiling panels are covered by a fabric or other decorative covering or finishing material 10. The panels include, adjacent the corners thereof, torsion spring engaging clips 12 which trap the top flange of the framed periphery 6 in a 'U' shaped slot. The wound portion 16 of the torsion spring is engaged by the clip 14 and connects the torsion spring to the ceiling panel to allow suspension thereof beneath the grid network 50. The torsion spring includes spring arms 18 which engage the butterfly clips 30 at various points along the length of the spring arms. Each spring arm includes a retaining foot 20 at a distal end thereof.

The butterfly clip 30 has a downwardly opening channel 32 for straddling the upper bead 54, preferably of a main T shown as 51. The upper bead 54 of different 'T' bar grid systems can vary somewhat, but are of a similar width whereby a single size of the downwardly opening channel 32 is suitable for the common suppliers of 'T' bar grid systems, particularly when a screw type fastener is used to secure the butterfly clip to the bead. In order to provide positive locking of the butterfly clip 30 to a main T 51 or a cross T 52, a mechanical fastener, in this case a releasable mechanical fastener 40 in the form of a metal sheet screw, locks the butterfly clip to the upper bead 54.

The butterfly clip of FIG. 1 has been shown in a paired orientation with an adjacent butterfly clip, with a frangible bridge segment 38 securing the butterfly clips. Each of the butterfly clips include horizontal projecting flanges 34 either side of the downwardly opening channel and these flanges include slots for receiving torsion springs and releasably engaging the torsion springs. This provides a simple arrangement for securing of a ceiling panel beneath the 'T' bar grid system. One such panel 4A is shown in FIG. 1 and it can be seen that the ceiling panel 4A is in abutting engagement with the lower flange 53 of the main T and the lower flange 55 of the cross T 52 and is held in this position due to the torsion spring 18. Four such torsion springs would be provided at the corners of each rectangular panel. Alignment clips 90 can be secured centrally on the lower edges of the 'T' bar members and cooperate with the edges of the ceiling panels to align the ceiling panels with the 'T' bar members.

The 'T' bar grid system, generally shown as 50, is typically of a rectilinear grid configuration and there are a host of 'T' bar grid systems presently installed in buildings. These existing grid systems can be used in a retrofit application to provide a suspended ceiling panel system. Depending upon the type of panels being installed, the structural integrity of the grid may also have to be checked. By using the existing grid system, a time and cost benefit may be realized. This system has significant advantages even in new installations, in that installers have extensive experience with respect to installing of 'T' bar grid systems and often have fairly sophisticated equipment to carry this out quickly. Therefore, savings can be gained due to less time required to install the system. Furthermore, specialized grid networks can be provided, and again, there would be some savings in installation due to the ability of the installer to use a system with which he is already familiar. It can be appreciated that there is also an economy of scale in using a relatively high volume grid network as well as a marketplace which is very price competitive with respect to these type of grid networks.

Figure 2:
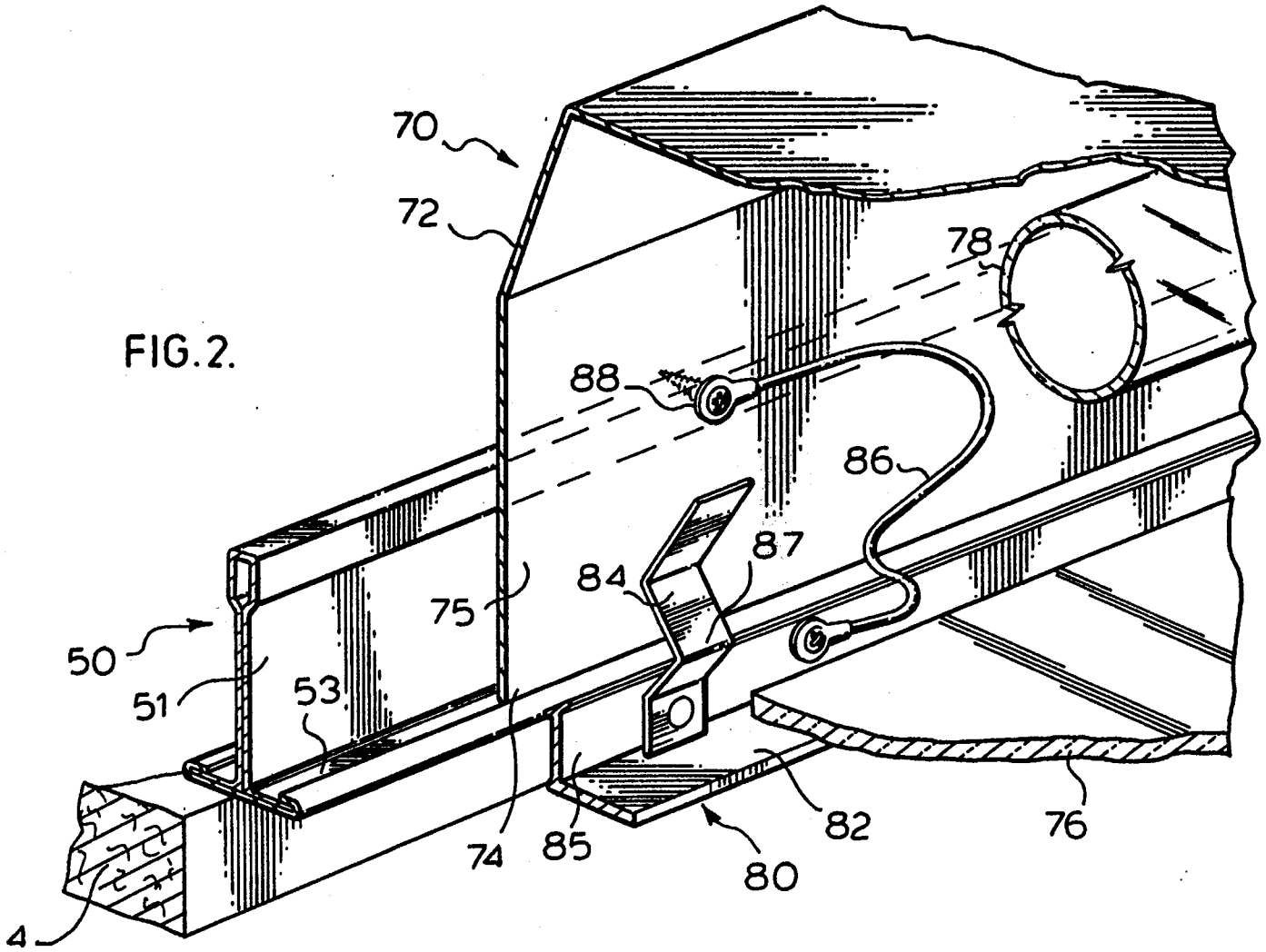
FIG. 2 is a partial perspective view showing the detail of conversion of a light fixture in an existing 'T' bar system to be flush with the bottom of the concealed grid ceiling system.

FIG. 2 shows details of an arrangement for extending a light fixture to the level of the ceiling of the suspended ceiling system. The actual height of the ceiling has been lowered due to suspension of the panels below the grid network. A light fixture 70 having a shell 72 is supported by the 'T' bar grid system 50, and in particular by the lower edge 74 of the light fixture being supported by the bottom flange of the main T 51. This is the typical arrangement for a fluorescent light fixture in a 'T' bar grid system and the fluorescent tube of the light fixture is generally shown as 78. The light fixture also includes a lens 76 which typically would be supported above the bottom flange of the main T 51 and possibly the bottom flange of the cross T's, which are not shown. Thus, the lower surface of the light lens generally corresponds with the level of the lower edge 74 of the light fixture 70. To overcome this problem, a rectangular frame 80 is provided which corresponds to the bottom opening of the light fixture. This rectangular frame is held by spring clips 84 below the lower edge of the light fixture. The free edge of the vertical member 85 is in contact with lower flange 53 of the 'T' bar and serves to space the member the appropriate distance below the 'T' bar. The spring clip 84 engages the side walls 75 of the light fixture with the 'L' shaped recess 87 acting as a cam locating surface with one edge of flange 53.

Typically, four spring clips would be provided, one adjacent each corner of the rectangular frame 80, to positively support the frame beneath the light fixture. The frame is at the level of the concealed grid ceiling system due to the vertical arm of the frame being in contact with the bottom flange of the 'T' bar. The lens 76, rather than being supported by the lower flange of the 'T' bar, is now supported by the lower flange 82 of the rectangular frame 80. The lens member may merely be angled and inserted into the light fixture and eventually supported by the lower flange 82 of the rectangular frame. The frame can also be lowered and the lens put in or the light fixture serviced.

Prior to installing of the lens 76, safety cable 86 may be positively secured to the light fixture by the screw 88. Several safety cables 86 may be provided to positively retain the frame beneath the light fixture. This may be required to satisfy certain safety or fire codes.

The present system, although suitable for retrofit applications, can also be used for new installations. The 'T' bar can be installed with only about 7½ inches clearance above, as opposed to about 12 inches if a normal 'T' bar and lay-in panel system was used. The reduced space is a result of the downward access of the system.

The actual size of the panels can vary, in that the butterfly clips preferably are supported by main T's. This allows the other dimension to vary. Furthermore, additional cross T's are easily inserted, if needed. The present system is economical, easily installed and flexible with respect to variation in panel size.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination, a 'T' bar grid system, securing clips and ceiling panels, said 'T' bar grid system comprising main T's and cross T's forming the grid system, each securing clip being secured to said grid system at a junction of the grid system and positioning a first segment of said clip on a main T and to one side of a cross T and positioning a second segment of the securing clip on the main T to the opposite side of said cross T, said ceiling panels including torsion springs for suspending thereof from said securing clips, said torsion springs being received in slots of said securing clips, said ceiling panels being sized to generally align corners of the ceiling panels beneath a junction of a main T and cross T, with a securing clip positioned to receive and engage a torsion spring of the ceiling panel, said ceiling panels abutting and collectively covering the grid system from below.

2. In combination as claimed in claim 1 wherein said first and second segments are interconnected by a frangible bridge segment.

3. In combination as claimed in claim 1 wherein said securing clips are each mechanically fastened to a main T of the grid system.

4. In combination as claimed in claim 1 wherein said grid system has a cell size and said ceiling panels are sized to correspond to the cell size.

5. In combination as claimed in claim 1 wherein said grid system defines a rectangular grid having a host of common sized cells and said ceiling panels are rectangular and of a size to cover one of the common sized cells of the rectangular grid and a portion of the main T's and cross T's defining the cell.

6. In combination as claimed in claim 5 wherein said first and second segments are interconnected by a bridge segment with said bridge segment overlying a junction of a main T and cross T of the grid system.

7. In combination as claimed in claim 6 wherein each ceiling panel has four torsion springs with each torsion spring hingedly secured at a corner of the ceiling panel and with each torsion spring releasably engaging a securing clip.

8. A securing clip for use in a suspended concealed grid ceiling system comprising:

a first segment and a second segment with said first and second segments interconnected by a rigid frangible bridge segment of substantially reduced size and strength relative to said first and second segments, each of said first and second segments comprising a downwardly opening 'U' shaped channel sized to closely straddle an upper bead of a 'T' bar grid member, extension flanges either side of said channel with each extension flange having a slot therein formed to engage and retain opposed legs of a torsion spring.

9. A securing clip as claimed in claim 8 wherein said securing clip includes an adjustable mechanical means associated with said 'U' shaped channels which cooperates with said 'U' shaped channels to effect positive securement of said clip to a 'T' bar grid member.

10. A securing clip as claimed in claim 9 wherein said mechanical means is a releasable mechanical fastener.

11. A securing clip as claimed in claim 9 wherein said releasable mechanical fastener includes a metal screw which passes through a port in said downwardly opening channel.

12. A securing clip as claimed in claim 8 wherein said rigid frangible bridge segment is an extension of a bottom of the downwardly opening channels of said first and second segments and wherein said bridge segment spaces said first and second segments sufficiently to accommodate the width of a a cross 'T' member forming a junction with a main 'T' member of a 'T' bar grid system.

13. A method of replacing a ceiling system comprising a 'T' bar grid and lay in panels with a concealed grid ceiling system having suspension ceiling panels supported from said 'T' bar grid, comprising:

removing the lay in panels of the 'T' bar ceiling system to fully expose the 'T' bar grid, securing clips at an upper edge of the 'T' bar grid system and positioning of the clips for edge support of the suspension ceiling panels, said clips having slots either side of the 'T' bar grid for engaging torsion springs, hingedly securing torsion springs to the suspension ceiling panels to accommodate horizontal suspension of the suspension ceiling panels beneath the 'T' bar grid, initially suspending the suspension ceiling panels in a generally horizontal position beneath the 'T' bar grid by securing the torsion springs in the clips, with the spacing of the clips on the 'T' bar grid corresponding to the spacing of the torsion springs when secured on a suspension ceiling panel, urging said suspension ceiling panels upwardly to contact the lower surface of the 'T' bar grid system, with said torsion springs also moving upwardly through slots of the clips and maintaining the suspension ceiling panels immediately below the 'T' bar grid, said suspension ceiling panels, when secured beneath the 'T' bar grid, abutting and concealing the 'T' bar grid.

14. A method as claimed in claim 13 wherein the ceiling panels are sized to correspond to a multiple of a cell size of the 'T' bar grid.

15. A method as claimed in claim 13 including securing alignment means on the lower surface of the 'T' bar grid, said alignment means engaging the ceiling panels and aligning the same beneath the grid system.

16. A method as claimed in claim 13 wherein the size of the suspension ceiling panels correspond to a rectangular cell size of the 'T' bar grid system and said clips are secured adjacent corners of each cell.

17. A method as claimed in claim 16 wherein said clips are paired and straddle an intersection junction of the 'T' bar grid whereby securing of said clips accurately positions suspension ceiling panels either side of a respective intersection junction.

* * * * *